US007411560B2

(12) United States Patent
Jordan

(10) Patent No.: US 7,411,560 B2
(45) Date of Patent: Aug. 12, 2008

(54) LOW PROFILE ANTENNAS AND DEVICES

(75) Inventor: David Frederick Jordan, Danville, NH (US)

(73) Assignee: M/A-Com, Inc., Lowell, MA (US)

( * ) Notice: Subject to any disclaimer, the term of this patent is extended or adjusted under 35 U.S.C. 154(b) by 0 days.

(21) Appl. No.: 11/537,616

(22) Filed: Sep. 30, 2006

(65) Prior Publication Data

US 2008/0079643 A1 Apr. 3, 2008

(51) Int. Cl.
*H01Q 21/00* (2006.01)

(52) U.S. Cl. ..... 343/725; 343/702; 343/895; 343/846

(58) Field of Classification Search ..... 343/725
See application file for complete search history.

(56) References Cited

U.S. PATENT DOCUMENTS 2,732,551 A * 1/1956 Kraus ..... 343/843
3,665,478 A * 5/1972 Dempsey ..... 343/725
4,396,920 A * 8/1983 Grimberg et al. ..... 343/846
6,229,489 B1 5/2001 Holshouser et al.
6,683,570 B2 1/2004 Skladany et al.
6,683,580 B2 1/2004 Kuramoto et al.
6,693,600 B1 * 2/2004 Elliot ..... 343/773
6,812,902 B2 11/2004 Rossman et al.
6,930,640 B2 * 8/2005 Chung et al. ..... 343/700 MS
6,956,533 B2 10/2005 Lindenmeier
2007/0013593 A1 * 1/2007 Zafar et al. ..... 343/713

* cited by examiner

*Primary Examiner*—Trinh V Dinh

(57) ABSTRACT

An apparatus includes a monopole extending substantially along an axis that may be vertical. However, the monopole may have a loop portion that deviates from the axis. Further, the apparatus includes multiple conductive elements, each having a substantially linear first segment that is coupled to the monopole. The first segments may be coplanar and/or perpendicular to the axis. Each of the conductive elements may further include a second segment that is substantially parallel to the axis. One or more of these segments may be connected to a ground potential. Also, the conductive elements may each include a third segment having a loop pattern.

18 Claims, 5 Drawing Sheets

LOW PROFILE ANTENNAS AND DEVICES

BACKGROUND

Antennas are often employed in various wireless applications, such as cellular telephony, global positioning system (GPS) location determination, digital satellite radio reception, and digital video broadcast (DVB) reception. It is generally desirable to reduce the size of antennas and their associated devices.

An antenna's size may be dictated by various operational characteristics, such as its operating frequencies, its specified signal quality requirements, and so forth. For example, an antenna's size typically increases as its operating frequencies decrease.

One technique for reducing the height of antenna devices involves the employment of "top loading" techniques. Such techniques place a load at an end of an element (e.g., a monopole) to make the element appear "electrically taller." Thus, top loading allows a shorter antenna to operate at a given frequency range.

Many conventional top loading techniques involve the use of relatively large top loads. Examples of such conventional top loads include circular or rectangular flat plates positioned at the top of an antenna device. Such conventional top loads may unfortunately occupy large footprints and block wireless signals being received and/or transmitted by nearby devices.

SUMMARY

The present invention provides an apparatus having a monopole extending substantially along an axis that may be substantially vertical. However, the monopole may have a loop portion that deviates from the axis. Further, the apparatus includes multiple conductive elements, each having a substantially linear first segment that is coupled to the monopole. The first segments may be coplanar and/or perpendicular to the axis. Further features and advantages of the invention will become apparent from the following description and accompanying drawings.

DETAILED DESCRIPTION

Various embodiments may be generally directed to antenna devices. Although embodiments may be described with a certain number of elements in a particular arrangement by way of example, the embodiments are not limited to such. For instance, embodiments may include greater or fewer elements, as well as other arrangements among elements.

Figure 1:
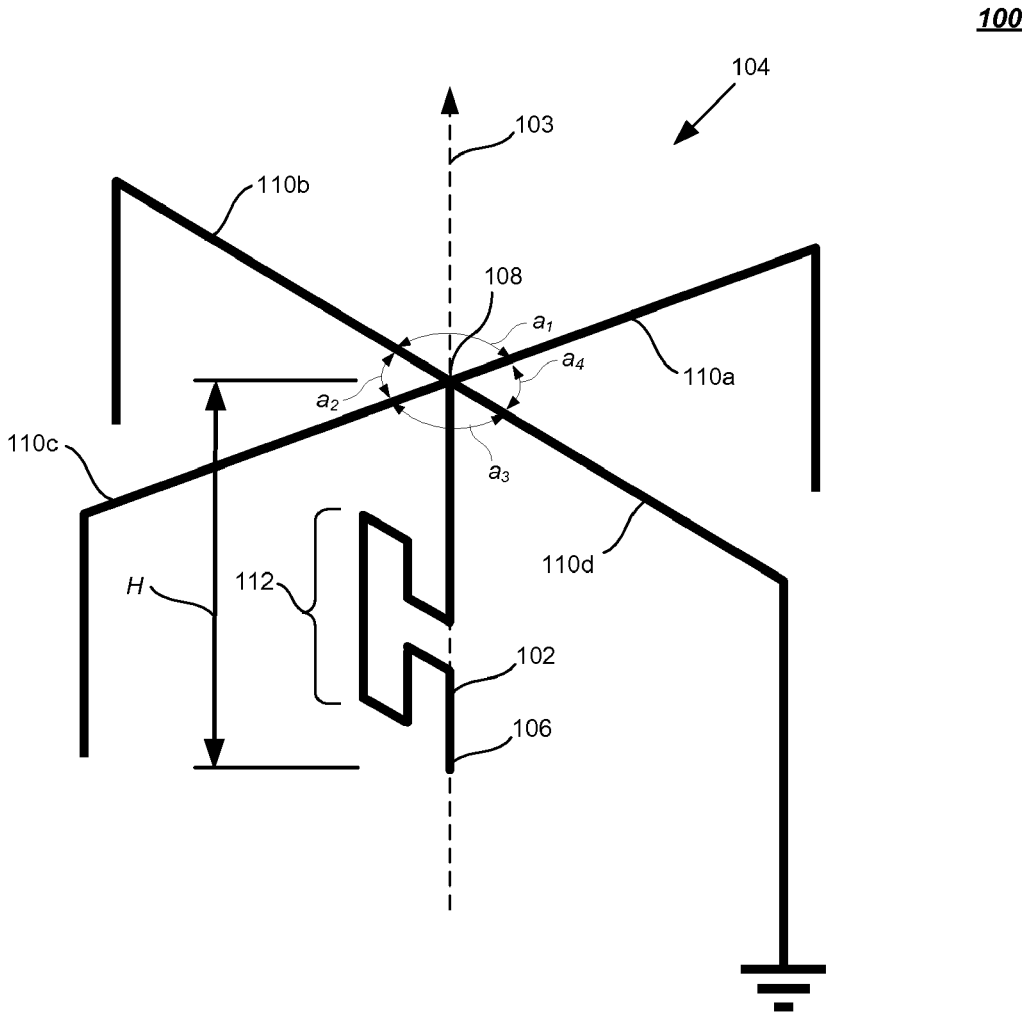
FIG. 1 is a view of an antenna device in accordance with an exemplary embodiment of the present invention.

FIG. 1 is a perspective view of an exemplary antenna apparatus 100. This apparatus may be used to transmit and/or receive wireless signals in one or more frequency bands. Apparatus 100 may include various elements. For instance, FIG. 1 shows apparatus 100 including a monopole 102 and a top load portion 104.

Monopole 102, which extends generally along an axis 103, has a bottom end 106 and a top end 108. A feed point may be located substantially at bottom end 106. At this point, one or more signal conveying media (such as a coaxial cable, wire (s), or trace(s)) may be coupled to antenna device 100.

Top load portion 104 may include multiple elements that are each coupled to monopole 102. For instance, FIG. 1 shows top load portion 104 including four conductive elements. However, other numbers of elements may be employed. In particular, FIG. 1 shows top load portion 104 having a first conductive element 110*a*, a second conductive element 110*b*, a third conductive element 110*c*, and a fourth conductive element 110*d*.

As shown in FIG. 1, each of conductive elements 110*a-d* has a first end that is coupled to monopole 102 at or near top end 108. However, each of conductive elements 110*a-d* has a second end that may be unconnected (e.g., floating) or connected to a predetermined potential. For example, FIG. 1 shows an end of conductive element 110*d* being connected to a ground potential. Through this connection, conductive element 110*d* may act as an impedance transformer to boost the input impedance of antenna device 100.

With reference to axis 103, conductive elements 110*a-d* are spaced radially according to angles $a_1$, $a_2$, $a_3$, and $a_4$. For instance, FIG. 1 shows angle $a_1$ being between conductive elements 110*a* and 110*b*, angle $a_2$ being between conductive elements 110*b* and 110*c*, angle $a_3$ being between conductive elements 110*c* and 110*d*, and angle $a_4$ being between conductive elements 110*d* and 110*a*. Such angles may be substantially equivalent. For example, in the embodiment of FIG. 1, angles $a_1$-$a_4$ may each be substantially ninety degrees (90°). However, embodiments may include non-equivalent angles.

As described above, monopole 102 extends generally along axis 103. However, monopole 102 may include a loop portion 112 that deviates from axis 103. Loop portion 112 may be positioned between ends 106 and 108. As shown in FIG. 1, loop portion 112 has a rectangular shape. However, other shapes may be employed. Loop portion 112 elongates (or increases the length) of monopole 102.

Through load portion 104 (which includes conductive elements 110*a-d*), antenna device 100 performs as though it is "electrically taller" than its actual size. Thus, antenna device 100 may effectively operate in a frequency range (or a range of wavelengths) that corresponds to a taller height. Additionally, load portion 104 may further serve to improve the Voltage Standing Wave Ratio (VSWR) bandwidth.

Moreover, through load portion 104, antenna device 100 may be arranged in close proximity with other antennas devices and impart less impact (e.g., less signal blockage) than conventional antenna devices would. An exemplary arrangement may include multiple (e.g., 3 or 4) antenna devices placed in close proximity within a single package.

Figure 2:
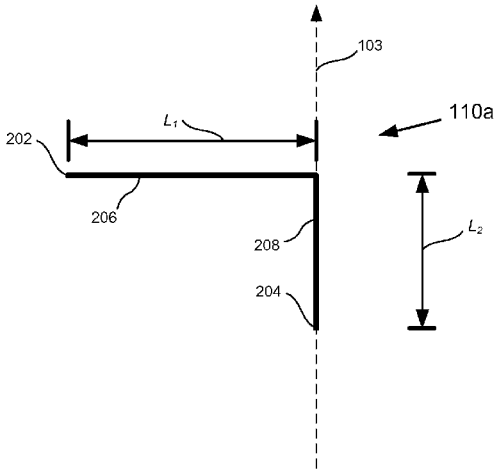
FIG. 2 is a view of a conductive element.

FIG. 2 is a side view showing a conductive element 110 with reference to axis 103. For purposes of convenience, FIG. 2 depicts conductive element 110*a*. However, other conductive elements (e.g., conductive elements 110*b*-110*d*) may be implemented in the same or similar manner.

As shown in FIG. 2, conductive element 110*a* has a proximal end 202 and a distal end 204. With reference to FIG. 1, proximal end 202 may be coupled to monopole 102 at or near top end 108.

Conductive elements (e.g., conductive elements 110*a*-110*d*) may each include multiple segments. For instance, FIG. 2 shows conductive element 110*a* having a first segment 206, and an adjacent second segment 208, while segment 208 includes distal end 204.

FIG. 2 shows that segment 206 is substantially linear and is substantially perpendicular to axis 103. Referring again to FIG. 1, conductive elements 110*b*, 110*c*, and 110*d* may also have segments that are similar to segment 206. In embodiments, these segments may lie in a plane that is substantially perpendicular to axis 103.

Segment 208 is also shown as being substantially linear, but having a different orientation than segment 206. More particularly, FIG. 2 shows segment 208 being substantially perpendicular to segment 206 and substantially parallel to axis 103. With reference to FIG. 1, conductive elements 110*b*, 110*c*, and/or 110*d* may also have segments that are similar to segment 208.

Figure 3:
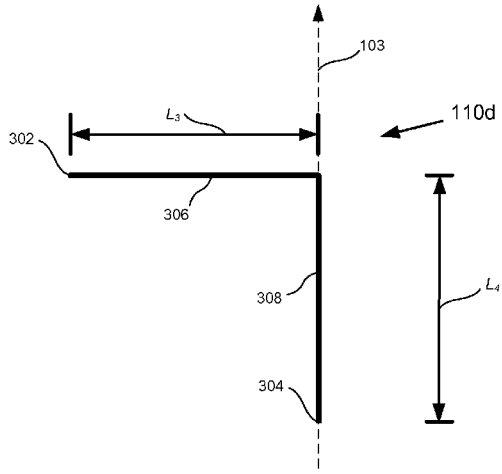
FIG. 3 is a view of an antenna apparatus having a conductive element that is connected to a ground potential.

FIG. 3 is a further side view showing conductive element 110*d* with reference to axis 103. In embodiments, other conductive elements (e.g., conductive elements 110*a-c*) may be implemented in the same or similar manner.

As shown in FIG. 3, conductive element 110*d* has a proximal end 302 and a distal end 304. With reference to FIG. 1, proximal end 302 may be coupled to monopole 102 at or near top end 108. FIG. 3 further shows conductive element 110*d* having a first segment 306 (which includes proximal end 302), and an adjacent second segment 308, (which includes distal end 304).

Segment 306 is shown as being substantially linear and substantially perpendicular to axis 103. Referring again to FIG. 1, conductive elements 110*a*, 110*b*, and/or 110*c* may also have segments that are similar to segment 306. As described above, such segments may lie in a plane that is substantially perpendicular to axis 103.

Segment 308 is also shown as being substantially linear, but having an orientation that is substantially perpendicular to segment 306 and substantially parallel to axis 103. With reference to FIG. 1, segment 308 may be coupled to a ground potential.

Although FIGS. 2 and 3 show segments 206, 208, 306, and 308 having linear shapes, the embodiments are not limited to such. For instance, antenna device embodiments may employ conductive element(s), which include one or more segments having various non-linear shapes.

Various dimensions are shown in FIGS. 1, 2, and 3. For instance, FIG. 1 shows monopole 102 having a height H. Also, FIG. 2 shows segment 206 having a length $L_1$ and segment 208 having a length $L_2$. In addition, FIG. 3 shows segment 306 having a length $L_3$ and segment 308 having a length $L_4$. An example embodiment H and $L_4$ are each approximately 1 inch, while $L_1$, $L_2$, and $L_3$ are each approximately 0.625 inches. However, the embodiments are not limited to these measurements.

Elements of antenna device 100 (such as monopole 102 and conductive elements) may be made from one or more suitable materials. Exemplary materials include conductors such as copper, stainless steel, and aluminum. However, embodiments of the present invention are not limited to these materials. Various thicknesses and cross sectional profiles may be employed with such conductors.

In addition to the depicted elements, other components may be included in antenna device. For example, a matching network (e.g., a passive network) may be coupled to antenna device 100 at its feed point (e.g., on or near end 106). Such a matching network may be configured to further improve the VSWR of antenna device 100.

As described above, antenna device may operate within one or more frequency bands. Such frequency band(s) may include the Advanced Mobile Phone System (AMPS) band from about 824 MHz to 894 MHz, the European GSM band from about 880 MHz to about 960 MHz, the PCS band from about 1850 MHz to 1990 MHz, and/or the European DCS1800 band from about 1710 MHz to about 1880 MHz. However, the embodiments are not limited to these exemplary frequency ranges. For instance, may additionally or alternatively operate in the Satellite Digital Audio Radio Service (SDARS) band from about 2320 MHz to 2345 MHz.

Embodiments of the present invention may include antenna devices supported by bases. For example, FIG. 4 is a view illustrating an exemplary arrangement 400 in which elements of antenna device 100 are supported by a base 402.

Figure 4:
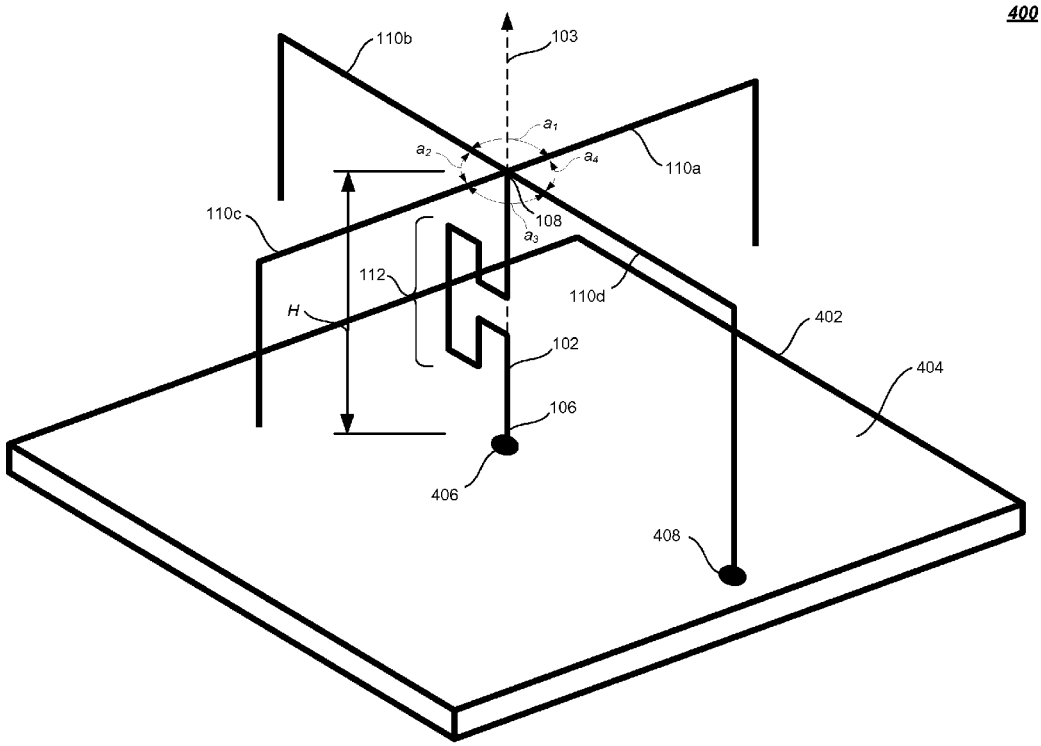
FIG. 4 is a perspective view of an antenna device supported by a base.

As shown in FIG. 4, base 402 has a surface 404. Substantial portions of surface 404 may be composed of (or have placed thereon) a conductive material to provide a ground plane. FIG. 4 shows that monopole 102 is attached to a feed point 406 of surface 404 (e.g., at or near bottom end 106) and conductive segment 110*d* is attached to a ground point or potential 408 of surface 404 (e.g., at or near distal end 304). These attachments may be made in various ways, such as with mechanical fasteners, soldering, brazing, adhesives, and so forth.

Base 402 may have a surface (not shown) that is opposite to surface 404. This surface may be attached to various devices and/or implements. For instance, this surface may attach to a vehicle, such as an automobile's exterior surface. Attachment may be made in different ways, such as with mechanical fasteners, adhesives, suction cups, and/or gaskets.

In embodiments, other antenna devices may also be attached to base 402 (for example on surface 404). Such devices may be of various types, such as printed, patch or microstrip antennas. In addition, such devices may support the transfer of various signals, such as cellular or satellite telephony signals, global positioning system (GPS) signals, video and/or radio broadcast signals (either analog or digital), SDAR signals, and the like.

One or more connectors may be attached to base 402. These connectors provide electrical connections between antenna device 100 (e.g., feed point 406) and one or more transmission lines (e.g., coaxial cables). In turn, such transmission lines may be further coupled to one or more electronic devices. Examples of such devices include cellular telephones, radio receivers, video receivers, computer devices (e.g., laptop computers, personal digital assistants (PDAs)), GPS receivers, and so forth.

In embodiments, arrangement 400 may include additional components. Examples of additional components include amplifiers, diplexers, matching networks, and so forth.

Figure 5:
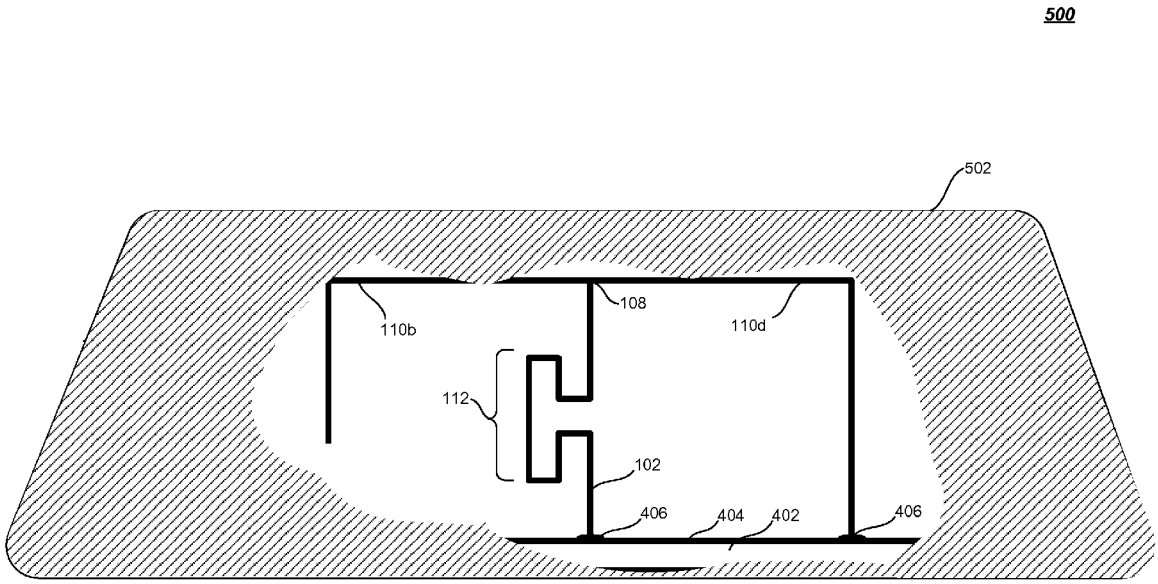
FIG. 5 is a side view of an antenna device covered by a radome.

FIG. 5 is a cut away side view in which the arrangement of FIG. 4 is covered by a radome 502. Radome 502 may be made of various materials, such as plastics having suitable microwave properties. Examples of such properties include a dielectric constant between 1 and 5, and a loss tangent between 0.01 and 0.001. In embodiments, radome 502 may be composed of an ultraviolet (UV) stable injection molded plastic.

Figure 6:
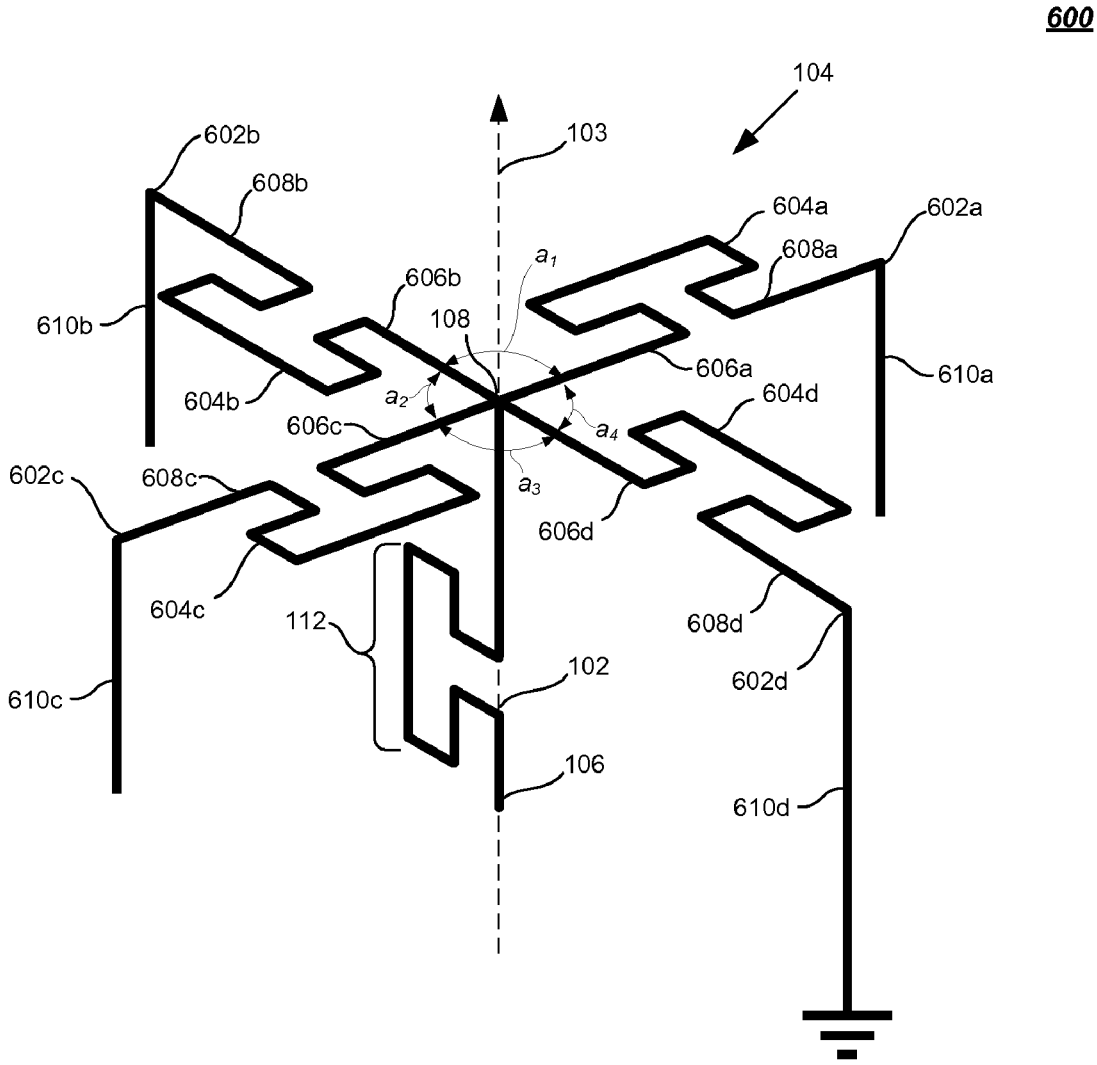
FIG. 6 is a perspective view of an antenna device in accordance with a further exemplary embodiment of the present invention.

FIGS. 1, 2 and 3, show top load conductive elements 110*a-d* having linear segments. However, as described above, other shapes may be employed. For instance, FIG. 6 shows an antenna apparatus 600 that employs such other shapes. Antenna apparatus 500 is similar to the apparatus shown in FIG. 1. However, in FIG. 6, conductive elements 110*a-d* are replaced with conductive elements 602*a-d*.

As shown in FIG. 6, conductive elements 602*a-d* include loop portions (or loop patterns) 604*a-d*, as well as substantially linear segments 606*a-d*, 608*a-d*, and 610*a-d*.

Each loop portion 604 is coupled between its corresponding segments 606 and 608. Each segment 606 is coupled to monopole 102, for example, on or near top end 108. Further each segment 610 is coupled to segment 608. Loop portions 604 and segments 606 and 608 may lie substantially in a plane that is perpendicular to axis 103. Also, segments 610 may be substantially parallel to axis 103.

As with the antenna device of FIG. 1, one of segments 610 (e.g., segment 610*d*) may be coupled to a ground potential.

Numerous specific details have been set forth herein to provide a thorough understanding of the embodiments. It will be understood by those skilled in the art, however, that the embodiments may be practiced without these specific details. In other instances, well-known operations, components and circuits have not been described in detail so as not to obscure the embodiments. It can be appreciated that the specific structural and functional details disclosed herein may be representative and do not necessarily limit the scope of the embodiments.

Thus, while the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

The invention claimed is:

1. An apparatus, comprising:

a monopole having one or more portions extending substantially along an axis; and four or more conductive elements, each conductive element including substantially linear first and second segments, wherein each of the first segments is coupled to the monopole and is substantially perpendicular to the axis, and wherein each of the second segments is substantially parallel to the axis, and at least one of the second segments has an end connected to a ground potential.

2. The apparatus of claim 1 wherein the first segments are substantially coplanar.

3. The apparatus of claim 2, wherein the first segments lie substantially within a plane that is perpendicular to the axis.

4. The apparatus of claim 1, wherein the monopole has a loop portion that deviates from the axis.

5. The apparatus of claim 1, wherein each conductive element further includes a third segment between the corresponding first and second segments, the third segment having a loop pattern.

6. The apparatus of claim 1, wherein the plurality of conductive elements are spaced radially in substantially equal increments about the axis.

7. The apparatus of claim 1, wherein the axis is substantially vertical.

8. The apparatus of claim 1, wherein the monopole and the plurality of conductive elements are arranged to exchange wireless signals within a frequency band from about 824 MHz to 894 MHz.

9. The apparatus of claim 1, wherein the monopole and the plurality of conductive elements are arranged to exchange wireless signals within a frequency band from about 1850 MHz to 1990 MHz.

10. The apparatus of claim 1, wherein the monopole and the plurality of conductive elements are arranged to exchange wireless signals within a frequency band from about 2320 MHz to 2345 MHz.

11. The apparatus of claim 1, further comprising a base, the base having a feed point coupled to the monopole and a ground potential coupled to one of the conductive elements.

12. The apparatus of claim 1, further comprising a radome enclosing the monopole and the plurality of conductive elements.

13. An apparatus, comprising:

a monopole having one or more portions extending substantially along an axis, the monopole further having an end; and four or more conductive elements coupled to the monopole;

wherein each conductive element includes a substantially linear segment coupled to the end of the monopole, wherein the substantially linear segments are substantially coplanar and spaced radially in substantially equal increments about the axis, and at least one of the conductive elements includes a second segment having an end connected to a ground potential.

14. The apparatus of claim 13, wherein each of the substantially linear segments are substantially perpendicular to the axis.

15. The apparatus of claim 13, wherein the monopole has a loop portion that deviates from the axis.

16. The apparatus of claim 13, wherein each conductive element further includes a second segment that is substantially parallel to the axis.

17. An apparatus, comprising:

a monopole having one or more portions extending substantially along an axis;

four or more conductive elements, each conductive element including a substantially linear first and second segments, wherein each of the first segments is coupled to the monopole and is substantially perpendicular to the axis, and wherein each of the second segments is substantially parallel to the axis; and a base having a feed point coupled to the monopole and a ground potential coupled to one of the conductive elements.

18. The apparatus of claim 17, further comprising a radome enclosing the monopole and the plurality of conductive elements.

* * * * *